US011074880B2

(12) United States Patent
Yeh

(10) Patent No.: US 11,074,880 B2
(45) Date of Patent: Jul. 27, 2021

(54) DISPLAY PANEL DRIVING METHOD FOR SAVING POWER AND DISPLAY PANEL DRIVING CIRCUIT THEREOF

(71) Applicant: Sitronix Technology Corp., Hsinchu County (TW)

(72) Inventor: Cheng-Chung Yeh, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 16/548,823

(22) Filed: Aug. 22, 2019

(65) Prior Publication Data

US 2020/0251062 A1 Aug. 6, 2020

Related U.S. Application Data

(60) Provisional application No. 62/721,616, filed on Aug. 23, 2018.

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 2310/0205* (2013.01); *G09G 2310/0243* (2013.01)

(58) Field of Classification Search
CPC .. G09G 3/3614; G09G 3/3688; G09G 3/3677; G09G 2310/0205; G09G 2310/0213; G09G 2310/0243
See application file for complete search history.

(56) References Cited

U.S. PATENT DOCUMENTS

| | | | | |
|---|---|---|---|---|
| 9,418,610 | B2 | 8/2016 | Huang | |
| 2004/0189572 | A1 | 9/2004 | Nose | |
| 2014/0015868 | A1 | 1/2014 | Yamazaki | |
| 2018/0211617 | A1* | 7/2018 | Li | G09G 3/3677 |

FOREIGN PATENT DOCUMENTS

| | | | |
|---|---|---|---|
| CN | 101923839 | A | 12/2010 |
| CN | 104793775 | A | 7/2015 |
| CN | 105474297 | A | 4/2016 |
| CN | 106710555 | A | 5/2017 |
| CN | 106940992 | A | 7/2017 |
| TW | 201303841 | A1 | 1/2013 |
| TW | 201303844 | A1 | 1/2013 |

* cited by examiner

*Primary Examiner* — Xuemei Zheng
(74) *Attorney, Agent, or Firm* — Winston Hsu

(57) ABSTRACT

A display panel driving method includes scanning a plurality of first gate lines of a plurality of gate lines according to a first predetermined order during a first time period of a frame period, and scanning a plurality of second gate lines of the gate lines according to a second predetermined order during a second time period of the frame period. Voltage polarity of a data signal located in any of a plurality of data lines remains unchanged during the first time period. Voltage polarity of the data signal located in any of the data lines remains unchanged during the second time period.

17 Claims, 13 Drawing Sheets

DISPLAY PANEL DRIVING METHOD FOR SAVING POWER AND DISPLAY PANEL DRIVING CIRCUIT THEREOF

CROSS REFERENCE TO RELATED APPLICATION

This application claims the benefit of U.S. provisional application No. 62/721,616, filed on Aug. 23, 2018, which is all incorporated herein by reference.

BACKGROUND OF THE INVENTION

1. Field of the Invention

The present invention relates to a display panel driving method and a display panel driving circuit, and more particularly, to a display panel driving method and a display panel driving circuit capable of saving power.

2. Description of the Prior Art

Different alignments of liquid crystals result in different polarization and refraction effects on light passing through the liquid crystals. Thus, light transmission ratios may be controlled by adjusting the alignments of liquid crystals. On the other hand, a liquid crystal material is required to be driven by a voltage of a periodically alternating voltage polarity, which is the so-called voltage polarity inversion, so as to avoid permanently damages on the liquid crystal material due to deformation and effects of ion trapping and direct current residue.

Liquid crystal display (LCD) driving methods may be categorized into frame inversion, line inversion, and dot inversion. In terms of frame inversion, data signals in each frame have the same voltage polarity, while data signals in next frame have an opposite voltage polarity to that in the previously frame. Line inversion may be further divided into row inversion and column inversion. In terms of row inversion, data signals in each row have an opposite voltage polarity to that in the neighboring row. In terms of column inversion, data signals in each column have an opposite voltage polarity to that in the neighboring column. In terms of pixel inversion, a data signal in each sub pixel has an opposite voltage polarity to that of the neighboring sub pixel.

However, when a gate driving circuit scans different rows, voltage polarity of a data signal outputted to one data line by a data driving circuit may be require inversion, for instance, row inversion or dot inversion. In other words, the number of inversion times of voltage polarity of a data signal located in a data line is proportional to the number of scanning times of the gate driving circuit. The data driving circuit must repetitively and alternately charge/discharge parasitic capacitor(s) of each data line of an LCD device, causing enormous driving power consumption. Therefore, how to practice voltage polarity inversion driving method (for example, row inversion and dot inversion) while saving more power has become significant challenges that need to be addressed.

SUMMARY OF THE INVENTION

In order to solve aforementioned problem(s), the present invention provides a display panel driving method and a display panel driving circuit capable of saving power.

The present invention discloses a display panel driving method. The display panel driving method includes scanning a plurality of first gate lines of a plurality of gate lines according to a first predetermined order during a first time period of a frame period, wherein a voltage polarity of a data signal located in any of a plurality of data lines remains unchanged during the first time period; and scanning a plurality of second gate lines of the gate lines according to a second predetermined order during a second time period of the frame period, wherein the voltage polarity of the data signal located in any of the data lines remains unchanged during the second time period.

The present invention further discloses a display panel driving circuit includes agate driving circuit generating a plurality of gate driving signals and transmitting the gate driving signals to a display panel, the gate driving signals including a plurality of first gate driving signals and a plurality of second gate driving signals, wherein the gate driving circuit transmits the first gate driving signals according to a first predetermined order during a first time period of a frame period and transmits the second gate driving signals according to a second predetermined order during a second time period of the frame period; and a data driving circuit generating a plurality of data signals and transmitting the data signals to the display panel, wherein a voltage polarity of a data signal located in any of a plurality of data lines remains unchanged during the first time period, and the voltage polarity of the data signal located in any of the data lines remains unchanged during the second time period.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular components. Manufacturers may refer to a component by different names as one skilled in the art may appreciate. Therefore, components shall be distinguished according to function instead of name. In the following description and claims, the terms "include" and "comprise" are used in an open-ended fashion, and thus should be interpreted to mean "include, but not limited to". Also, the term "couple" is intended to mean either an indirect or direct electrical connection. Accordingly, if one device is coupled to another device, the connection may belong to a direct electrical connection or an indirect electrical connection via other devices and connections.

Figure 1A:
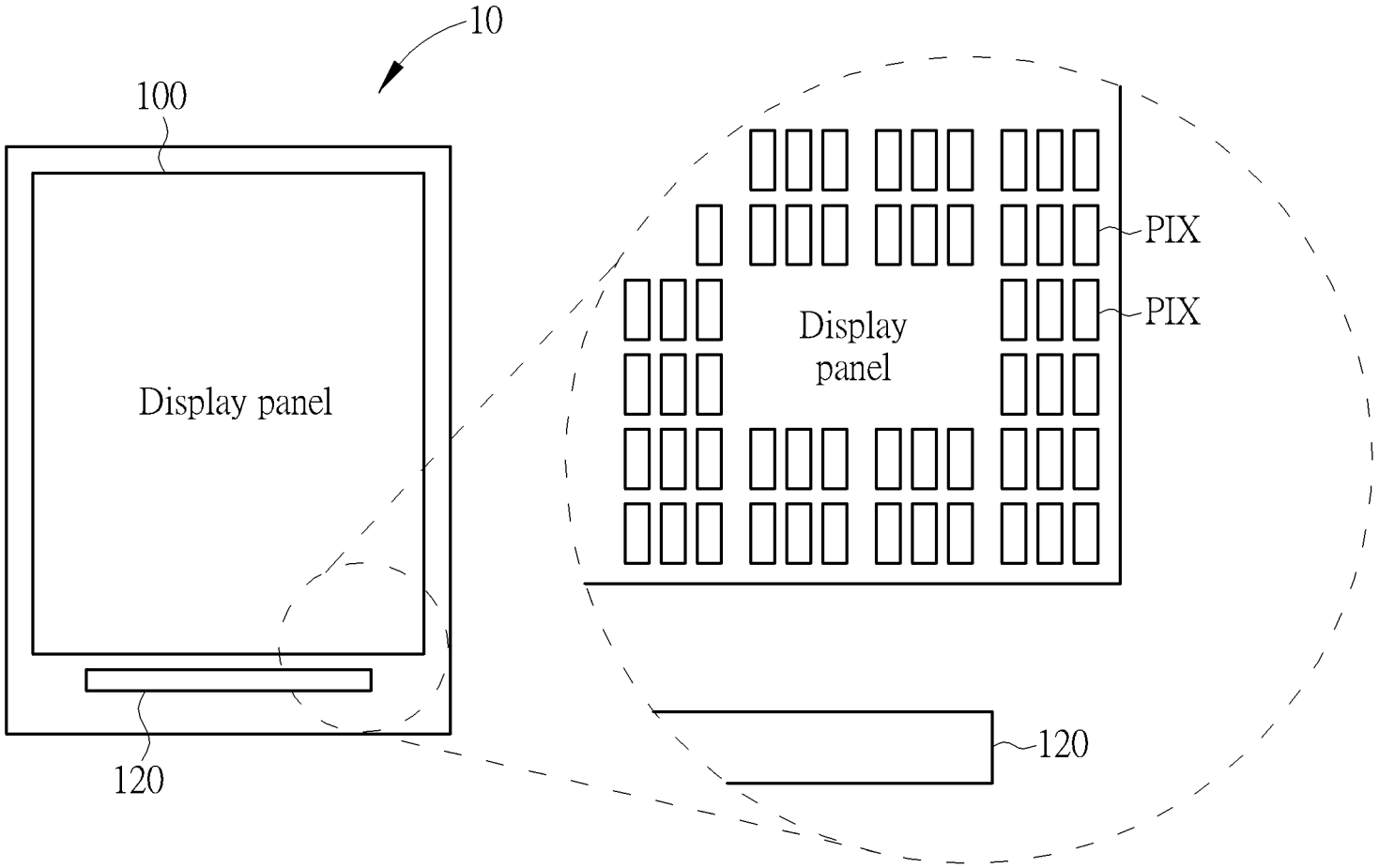
FIG. 1A is a schematic diagram of a display module according to an embodiment of the present invention.
Figure 1B:
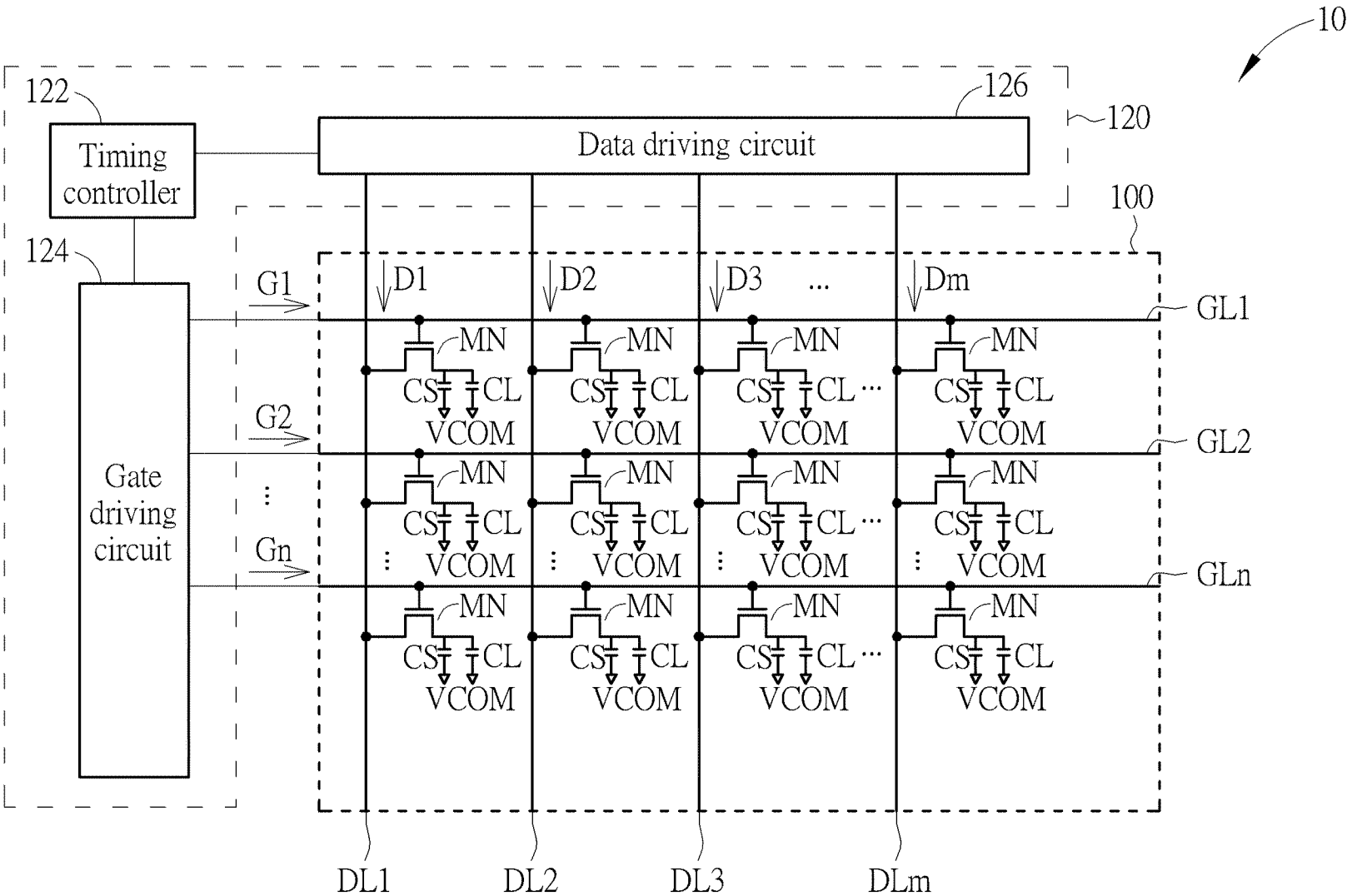
FIG. 1B is a schematic diagram of driving circuits of the display module and subpixels of a display panel shown in FIG. 1A according to an embodiment of the present invention.

Please refer to FIG. 1A and FIG. 1B. FIG. 1A is a schematic diagram of a display module 10 according to an embodiment of the present invention. FIG. 1B is a schematic diagram of driving circuits of the display module 10 and subpixels of a display panel 100 shown in FIG. 1A according to an embodiment of the present invention. The display module 10 may be a thin film transistor (TFT) liquid crystal display (LCD) device, and may be adopted in electronic products capable of displaying images—for example, a laptop, a smart phone, and so on. The display module 10 includes a display panel 100 and a display panel driving circuit 120. As shown in FIG. 1A and FIG. 1B, the display panel 100 includes a plurality of gate lines GL1-GLn, a plurality of data lines DL1-DLm and a plurality of subpixels PIX arranged in an array, wherein m, n are positive integrals. Each junction of the gate lines GL1-GLn and the data lines DL1-DLm is respectively coupled to a transistor MN of a subpixel PIX. Each transistor MN is coupled to capacitors CS, CL. Each capacitor CL is a liquid crystal capacitor, which represents an equivalent capacitor of one of the subpixels PIX of the display panel 100. Each capacitor CS is a storage capacitor. The capacitors CS, CL may be coupled to a common voltage VCOM of the display module 10. Alternatively, the (storage) capacitor CS may not be coupled to the common voltage VCOM. As shown in FIG. 1B, the display panel driving circuit 120 includes a timing controller 122, a gate driving circuit 124 and a data driving circuit 126. The timing controller 122 is coupled to the gate driving circuit 124 and the data driving circuit 126. The timing controller 122 is configured to provide a timing signal to the gate driving circuit 124 and the data driving circuit 126 so as to control (timing) operations of the gate driving circuit 124 and the data driving circuit 126. The gate driving circuit 124 is configured to generate a plurality of gate driving signals G1-Gn according to the timing signal and transmit the gate driving signals G1-Gn to the gate lines GL1-GLn so as to enable the gate lines GL1-GLn of the display panel 100, control conduction of the transistors MN, and thus control update timing of subpixels PIX in each row. The data driving circuit 126 is configured to generate and output data signals D1-Dm to the data lines DL1-DLm of the display panel 100 according to the timing signal so as to transmit the data signals D1-Dm to the corresponding subpixels PIX. Accordingly, the display panel driving circuit 120 may control pixel voltage of each of the subpixels PIX in order to control rotation angles (or alignments) of liquid crystals.

Figure 2:
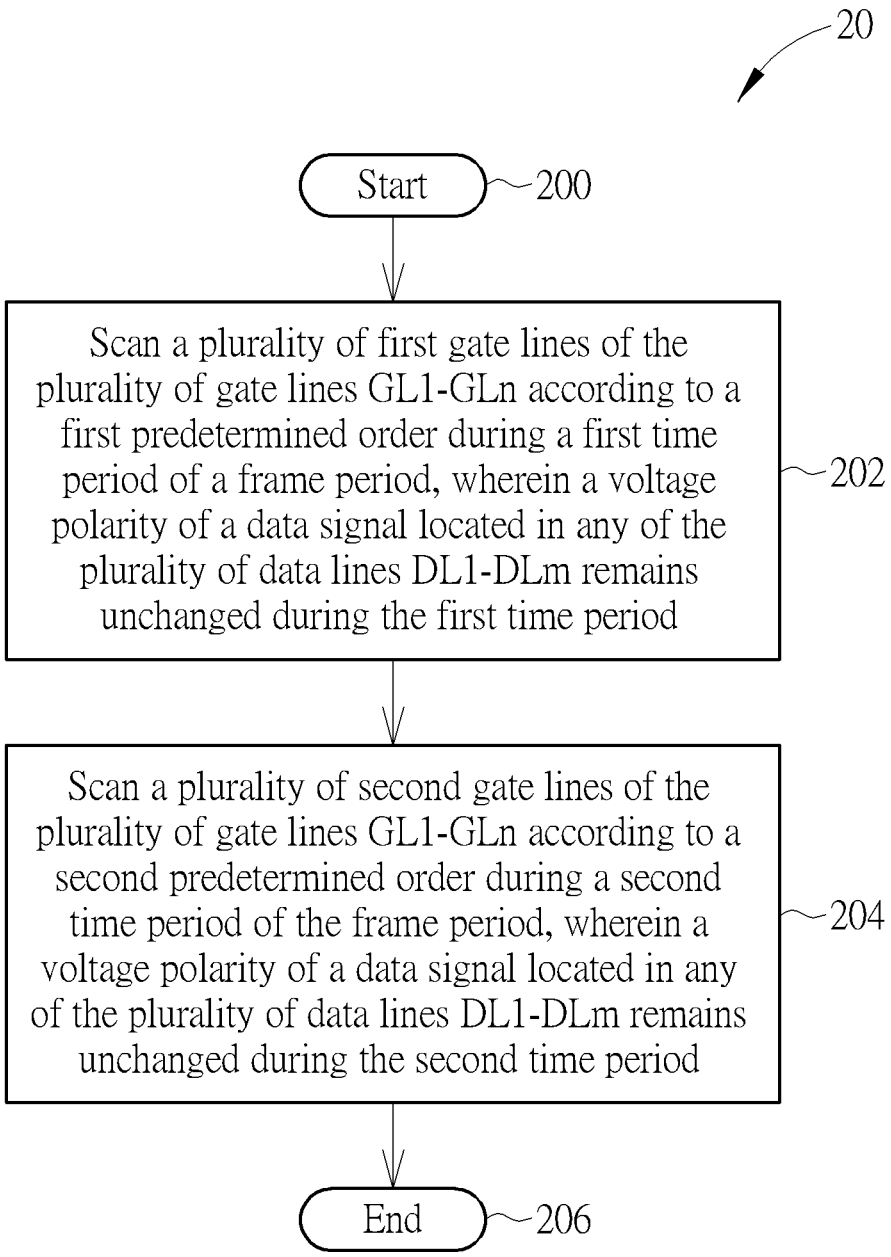
FIG. 2 is a flowchart of a display panel driving method according to an embodiment of the present invention.

Please refer to FIG. 2, which is a flowchart of a display panel driving method 20 according to an embodiment of the present invention. Specifically, operations of the display panel driving circuit 120 to update pixel voltages of the subpixels PIX during the display of different frames may be summarized as the display panel driving method 20. The display panel driving method 20 includes following steps:

Step 200: Start.

Step 202: Scan a plurality of first gate lines of the plurality of gate lines GL1-GLn according to a first predetermined order during a first time period of a frame period, wherein a voltage polarity of a data signal located in any of the plurality of data lines DL1-DLm remains unchanged during the first time period.

Step 204: Scan a plurality of second gate lines of the plurality of gate lines GL1-GLn according to a second predetermined order during a second time period of the frame period, wherein the voltage polarity of the data signal located in any of the plurality of data lines DL1-DLm remains unchanged during the second time period.

Step 206: End.

In short, the number of times of inversion of voltage polarities of the data signals D1-Dm is reduced, thereby reducing driving power consumption and achieving power saving.

Figure 3A:
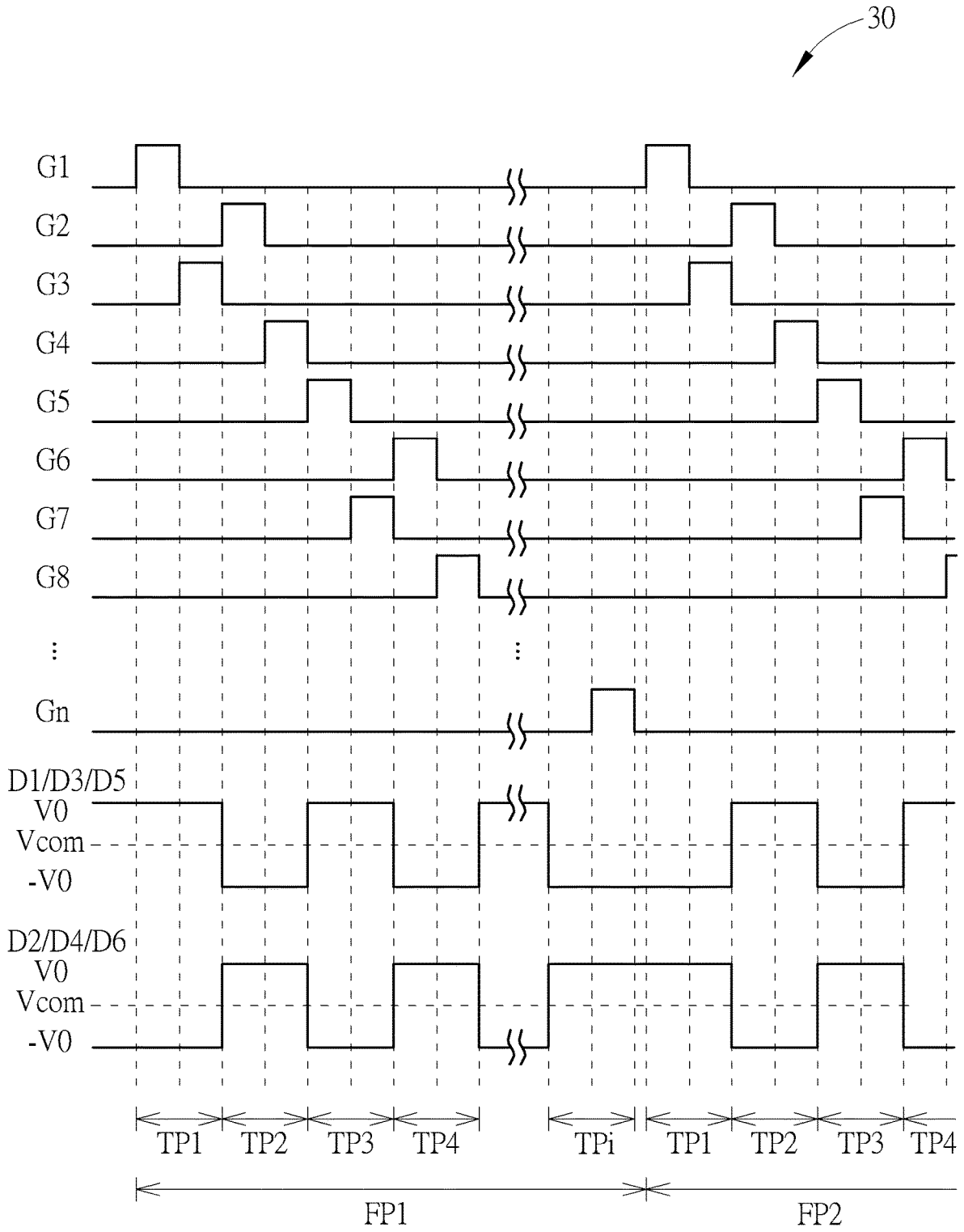
FIG. 3A is a timing diagram of gate driving signals and data signals based on a display panel driving method according to an embodiment of the present invention.
Figure 3B:
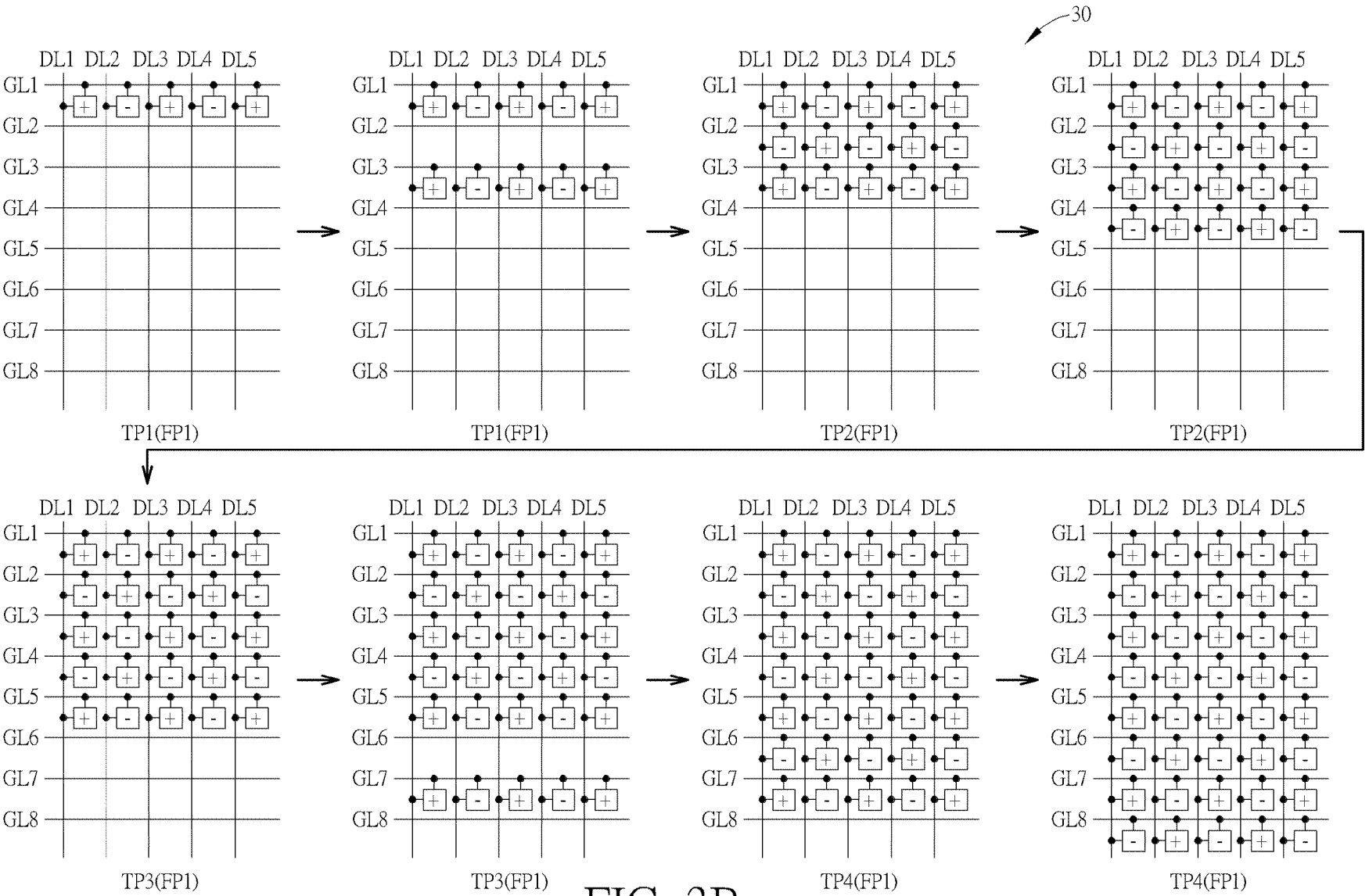
FIG. 3B is a schematic diagram of voltage polarities of data signals of the subpixels of the display panel based on a display panel driving method according to an embodiment of the present invention.

Please refer to FIG. 3A and FIG. 3B for specific operations of the display panel driving method 20 shown in FIG. 2. FIG. 3A is a timing diagram of gate driving signals and data signals based on the display panel driving method 30 according to an embodiment of the present invention. FIG. 3B is a schematic diagram of voltage polarities of data signals of the subpixels PIX of the display panel 100 based on the display panel driving method 30 according to an embodiment of the present invention. The display panel driving method 30 is similar to the display panel driving method 20. Specifically, as shown in FIG. 3A, a frame period FP1, which involves a length of time for the display panel 100 to display one frame, may be divided into a plurality of time periods TP1-TPi, wherein i is a positive integral. For instance, the frame period FP1 at least includes the time period TP1 (also referred to as a first time period), the time period TP2 (also referred to as a second time period), the time period TP3 (also referred to as a third time period), and the time period TP4 (also referred to as a fourth time period). Similarly, a frame period FP2 may be divided into (the) time periods TP1-TPi as well. The gate lines GL1-GLn may be categorized or put into different scan line groups. For example, the gate lines GL1-GLn may at least be grouped into first gate lines (also referred to as a first scan line group), second gate lines (also referred to as a second scan line group), third gate lines (also referred to as a third scan line group), and fourth gate lines (also referred to as a fourth scan line group). The first gate lines include the gate lines GL1, GL3. The second gate lines include the gate lines GL2, GL4. The third gate lines include the gate lines GL5, GL7. The fourth gate lines include the gate lines GL6, GL8.

As shown in FIG. 3A and FIG. 3B, during the first time period TP1 of the frame period FP1, the gate driving circuit 124 scans the first gate lines GL1, GL3 according to a first predetermined order, meaning that the gate driving circuit 124 transmits gate driving signals G1, G3 (also referred to as first gate driving signals) to the first gate lines GL1, GL3. In this embodiment, the number of the first gate lines is 2. The first gate lines are not disposed side by side (namely, nonadjacent) but located in odd rows; in other words, the gate driving signals G1, G3 transmitted to the first gate lines GL1, GL3 of the display panel 100 are not adjacent, but not limited thereto. The first gate line GL1 is located in the $1^{st}$ row (namely, the $M^{th}$ row, and M is a positive integral such as 1), the first gate line GL3 is located in the $3^{rd}$ row (namely, the $M+x^{th}$ row, and x is an integral such as 2). Specifically, in this embodiment, the gate driving circuit 124 scans the first gate line GL1 first, and then scans the first gate line GL3. That is to say, the first predetermined order is sequenced in an ascending order of row numbers and relates to a sequence of row numbers (namely, the order of row number). Besides, the first gate driving signals G1, G3 sequentially turn on the transistors MN located in the first gate lines GL1, GL3 in different timings during the first time period TP1 so that the data signals D1-Dm charge the subpixels PIX located in the first gate lines GL1, GL3 during the first time period TP1, respectively.

In this embodiment, the display panel driving circuit 120 employs dot inversion driving method to drive the subpixels PIX of the display panel 100. During the first time period TP1, voltage polarities of data signals located in two adjacent data lines DL1-DLm (for example, the data signal D1 of the data line DL1 and the data signal D2 of the data line DL2) are opposite. However, during the first time period TP1, voltage polarity of any of the data signals D1-Dm located in the data lines DL1-DLm remains unchanged, instead of inverting the voltage polarities of the data signals D1-Dm as the gate driving circuit 124 starts to scan another (different) gate line. As a result, the present invention may reduce driving power consumption and achieve power saving. Specifically, in this embodiment, voltage polarity of the data signal D1 of the data line DL1 is always positive during the first time period TP1. For example, a level of the data signal D1 is a positive voltage V0. Similarly, voltage polarities of data signals of data lines located in odd columns (for example, the data signal D3 of the data line DL3 and the data signal D5 of the data line DL5) are positive during all the first time period TP1. On the other hand, voltage polarity of the data signal D2 of the data line DL2 is always negative during the first time period TP1. For example, a level of the data signal D2 is a negative voltage −V0. Similarly, voltage polarities of data signals of data lines located in even columns (for example, the data signals D4, D6 of the data lines DL4, DL6) are negative during all the first time period TP1.

During the second time period TP2 of the frame period FP1, the gate driving circuit 124 scans the second gate lines GL2, GL4 according to a second predetermined order, meaning that the gate driving circuit 124 transmits gate driving signals G2, G4 (also referred to as second gate driving signals) to the second gate lines GL2, GL4. In this embodiment, the number of the second gate lines is 2. The second gate lines are nonadjacent to each other but located in even rows; in other words, the gate driving signals G2, G4 transmitted to the second gate lines GL2, GL4 of the display panel 100 are not adjacent, but not limited thereto. The second gate line GL2 is located in the $2^{nd}$ row (namely, the $M+y^{th}$ row, and y is an integral such as 1), the second gate line GL4 is located in the $4^{th}$ row (namely, the $M+y+z^{th}$ row, and z is an integral such as 2). Specifically, in this embodiment, the gate driving circuit 124 scans the second gate lines GL2 first, and then scans the second gate line GL4. That is to say, the second predetermined order is sequenced in an ascending order of row numbers and relates to a sequence of row numbers. Besides, the second gate driving signals G2, G4 sequentially turn on the transistors MN located in the second gate lines GL2, GL4 in different timings during the second time period TP2 so that the data signals D1-Dm charge the subpixels PIX located in the second gate lines GL2, GL4 during the second time period TP2, respectively.

During the second time period TP2, voltage polarities of data signals located in two adjacent data lines DL1-DLm (for example, the data signal D1 of the data line DL1 and the data signal D2 of the data line DL2) are opposite. Voltage polarities of data signals located in the data lines DL1-DLm during the first time period TP1 are opposite to those during the second time period TP2. However, during the second time period TP2, voltage polarity of any of the data signals D1-Dm located in the data lines DL1-DLm remains unchanged, instead of inverting the voltage polarities of the data signals D1-Dm as the gate driving circuit 124 starts to scan another (different) gate line. As a result, the present invention may reduce driving power consumption and achieve power saving. Specifically, in this embodiment, voltage polarity of the data signal D1 of the data line DL1 is always negative during the second time period TP2, and is opposite to its voltage polarity during the first time period TP1. Similarly, voltage polarities of data signals of data lines located in odd columns (for example, the data signals D3, D5 of the data lines DL3, DL5) are negative during all the second time period TP2, and are opposite to the voltage polarities of data signals of data lines located in odd columns during the first time period TP1. On the other hand, voltage polarity of the data signal D2 of the data line DL2 is always positive during the second time period TP2, and is opposite to the voltage polarity of the data signal D2 of the data line DL2 during the first time period TP1. Similarly, voltage polarities of data signals of data lines located in even columns (for example, the data signals D4, D6 of the data lines DL4, DL6) are positive during all the second time period TP2, and are opposite to the voltage polarities of data signals of data lines located in even columns during the first time period TP1.

During the third time period TP3 of the frame period FP1, the gate driving circuit 124 scans the third gate lines GL5, GL7 according to a third predetermined order, meaning that the gate driving circuit 124 transmits gate driving signals G5, G7 (also referred to as third gate driving signals) to the third gate lines GL5, GL7. In this embodiment, the number of the third gate lines is 2. The third gate lines are nonadjacent to each other but located in odd rows. Specifically, in this embodiment, the gate driving circuit 124 scans the third gate line GL5 first, and then scans the third gate line GL7. That is to say, the third predetermined order is sequenced in an ascending order of row numbers, and relates to a sequence of row numbers. Besides, the third gate driving signals G5, G7 sequentially turn on the transistors MN located in the third gate lines GL5, GL7 in different timings during the third time period TP3 so that the data signals D1-Dm charge the subpixels PIX located in the third gate lines GL5, GL7 during the third time period TP3, respectively.

During the third time period TP3, voltage polarities of data signals located in two adjacent data lines DL1-DLm (for example, the data signal D1 of the data line DL1 and the data signal D2 of the data line DL2) are opposite. Voltage polarities of data signals located in the data lines DL1-DLm during the second time period TP2 are opposite to those during the third time period TP3. However, during the third time period TP3, voltage polarity of any of the data signals D1-Dm located in the data lines DL1-DLm remains unchanged. As a result, the present invention may reduce driving power consumption and achieve power saving. Specifically, in this embodiment, voltage polarities of data signals of data lines located in odd columns (for example, the data signals D1, D3, D5 of the data lines DL1, DL3, DL5) are positive during all the third time period TP3, and are opposite to the voltage polarities of data signals of data lines located in odd columns during the second time period TP2. On the other hand, voltage polarities of data signals of data lines located in even columns (for example, the data signals D2, D4, D6 of the data lines DL2, DL4, DL6) are negative during all the third time period TP3, and are opposite to the voltage polarities of data signals of data lines located in even columns during the second time period TP2.

During the fourth time period TP4 of the frame period FP1, the gate driving circuit 124 scans the fourth gate lines GL6, GL8 according to a fourth predetermined order, meaning that the gate driving circuit 124 transmits gate driving signals G6, G8 (also referred to as fourth gate driving signals) to the fourth gate lines GL6, GL8. In this embodiment, the number of the fourth gate lines is 2. The fourth gate lines are nonadjacent to each other but located in even rows. Specifically, in this embodiment, the gate driving circuit 124 scans the fourth gate line GL6 first, and then scans the fourth gate line GL8. That is to say, the fourth predetermined order is sequenced in an ascending order of row numbers, and relates to a sequence of row numbers. Besides, the fourth gate driving signals G6, G8 sequentially turn on the transistors MN located in the fourth gate lines GL6, GL8 in different timings during the fourth time period TP4 so that the data signals D1-Dm charge the subpixels PIX located in the fourth gate lines GL6, GL8 during the fourth time period TP4, respectively.

During the fourth time period TP4, voltage polarities of data signals located in two adjacent data lines DL1-DLm (for example, the data signal D1 of the data line DL1 and the data signal D2 of the data line DL2) are opposite. Voltage polarities of data signals located in the data lines DL1-DLm during the third time period TP3 are opposite to those during the fourth time period TP4. However, during the fourth time period TP4, voltage polarity of any of the data signals D1-Dm located in the data lines DL1-DLm remains unchanged. As a result, the present invention may reduce driving power consumption and achieve power saving. Specifically, in this embodiment, voltage polarities of data signals of data lines located in odd columns (for example, the data signals D1, D3, D5 of the data lines DL1, DL3, DL5) are negative during all the fourth time period TP4, and are opposite to the voltage polarities of data signals of data lines located in odd columns during the third time period TP3. On the other hand, voltage polarities of data signals of data lines located in even columns (for example, the data signals D2, D4, D6 of the data lines DL2, DL4, DL6) are positive during all the fourth time period TP4, and are opposite to the voltage polarities of data signals of data lines located in even columns during the third time period TP3.

Operations during other time periods TP5-TPi of the frame period FP1 are similar, and thus are not narrated hereinafter. Besides, operations during the time period TP1-TPi of the frame period FP2 are also similar, and hence are not detailed redundantly. It is noteworthy that voltage polarities of data signals D1-Dm located in the data lines DL1-DLm during the time periods TP1-TPi of the frame period FP1 are opposite to those during the time periods TP1-TPi of the frame period FP2.

As set forth above, because the display panel driving method 30 of the display panel driving circuit 120 adopts dot inversion, display quality is ensured. Besides, voltage polarity of a data signal (for example, the data signal D1) is inverted merely once whenever a time period is passed (for example, the change from the first time period TP1 to the second time period TP2), and the gate driving circuit 124 scans a plurality of gate lines in one scan line group (for example, the first gate lines GL1, GL3 of the first scan line group) during the same time period (for example, the first time period TP1). In other words, the number of times of inversion of the voltage polarities of the data signals D1-Dm is less than the number of times of scanning of the gate driving circuit 124, thereby reducing driving power consumption and achieving power saving.

The display panel driving method of the present invention categorizes gate lines GL1-GLn into groups according to the voltage polarities of the data signals D1-Dm corresponding to each of the gate lines GL1-GLn is scanned. With unchanged voltage polarities of the data signals D1-Dm, different gate lines are put into the same scan line group. It is just illustrated as the aforementioned embodiment where the display panel driving circuit 120 utilizes dot inversion driving method to drive the subpixels PIX of the display panel 100. When the gate lines in odd rows (for example, the gate lines GL1, GL3) are scanned, the voltage polarities of the data signals D1-Dm remains unchanged; therefore, the gate lines GL1, GL3 belong to the same scan line group. Similarly, when the gate lines of even rows (for example, the gate lines GL2, GL4) are scanned, the voltage polarities of the data signals D1-Dm remains unchanged; therefore, the gate lines GL2, GL4 belong to the same scan line group. As a result, when a plurality of scan lines of the same scan line group are scanned during one time period, there is no need for the data driving circuit 126 to change the voltage polarities of the data signals D1-Dm so as to reduce the number of times of inversion of the voltage polarities of the data signals D1-Dm, thereby reducing driving power consumption and achieving power saving. The subpixels PIX of the display panel 100 in all following embodiments are driven by the same principle to achieve power saving.

The aforementioned is an exemplary embodiment of the present invention, and those skilled in the art may readily make different alternations and modifications. For example, the number of gate lines of a scan line group is not limited to 2, and may be other numbers. Besides, the predetermined order for the gate driving circuit 124 to scan gate lines may not be in the ascending order of row numbers but may be unrelated to a sequence of row numbers. The gate driving circuit 124 may not start scanning from an outermost gate line (for example, an uppermost or lowermost gate line). Specifically, please refer to FIG. 4, which is a schematic diagram of voltage polarities of data signals of the subpixels PIX of the display panel 100 based on a display panel driving method 40 according to an embodiment of the present invention. The display panel driving method 40 is substantially similar to the display panel driving method 30. Different from the display panel driving method 30, the number of gate lines of a scan line group in the display panel driving method 40 is 3. For example, the gate lines GL1-GLn may at least be grouped into the first gate lines GL1, GL3, GL5 (also referred to as a first scan line group), the second gate lines GL2, GL4, GL6 (also referred to as a second scan line group). The first gate lines GL1, GL3, GL5 are nonadjacent to each other but located in odd rows; the second gate lines GL2, GL4, GL6 are nonadjacent to each other but located in even rows.

Figure 4:
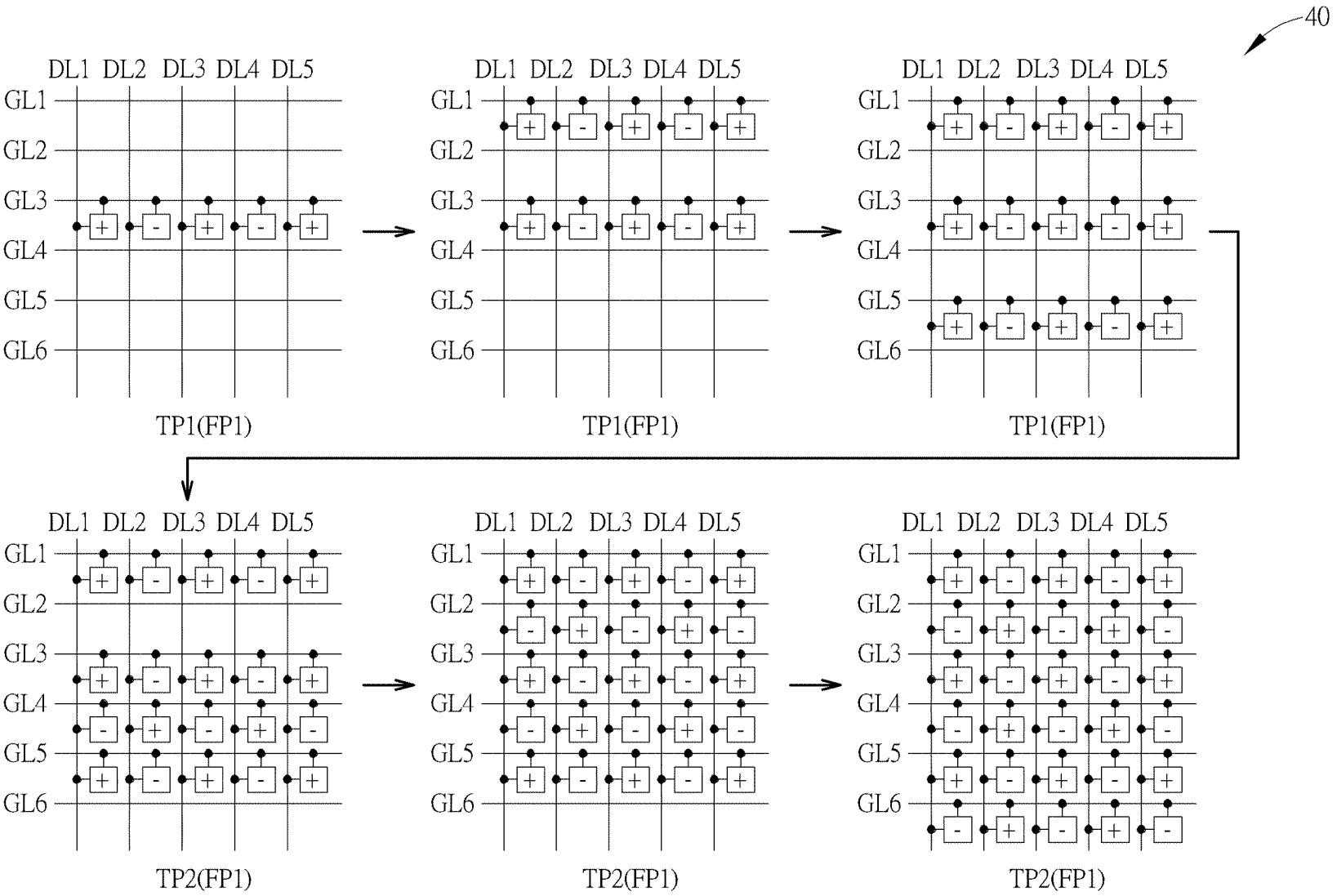
FIG. 4-7 are respectively schematic diagrams of voltage polarities of data signals of the subpixels of the display panel based on a display panel driving method according to an embodiment of the present invention.

As shown in FIG. 4, during the first time period TP1 of the frame period FP1, the gate driving circuit 124 scans the first gate lines GL3, GL1, GL5 according to a first predetermined order, meaning that the gate driving circuit 124 transmits gate driving signals G3, G1, G5 (also referred to as first gate driving signals) to the first gate lines GL3, GL1, GL5.

Specifically, in this embodiment, the gate driving circuit 124 scans the first gate line GL3 first, then scans the first gate line GL1, and then scans the first gate line GL5. That is to say, the first predetermined order does not directly relate to a sequence of row numbers. Besides, the gate driving circuit 124 does not start scanning from the uppermost first gate line GL1.

During the second time period TP2 of the frame period FP1, the gate driving circuit 124 scans the second gate lines GL4, GL2, GL6 according to a second predetermined order, meaning that the gate driving circuit 124 transmits gate driving signals G4, G2, G6 (also referred to as second gate driving signals) to the second gate lines GL4, GL2, GL6. Specifically, in this embodiment, the gate driving circuit 124 scans the second gate line GL4 first, then scans the second gate line GL2, and then scans the second gate line GL6. That is to say, the second predetermined order does not directly relate to a sequence of row numbers.

Operations during other time periods TP3-TPi of the frame period FP1 are similar, and thus are not narrated hereinafter. Besides, operations during the time period TP1-TPi of the frame period FP2 are also similar, and hence are not detailed redundantly. It is noteworthy that voltage polarities of data signals D1-Dm located in the data lines DL1-DLm during the time periods TP1-TPi of the frame period FP1 are opposite to those during the time periods TP1-TPi of the frame period FP2.

As set forth above, because the display panel driving method 40 of the display panel driving circuit 120 adopts dot inversion, display quality is ensured. Besides, voltage polarity of a data signal (for example, the data signal D1) is inverted merely once whenever a time period is passed (for example, the change from the first time period TP1 to the second time period TP2), and the gate driving circuit 124 scans a plurality of gate lines in one scan line group (for example, the first gate lines GL1, GL3, GL5 of the first scan line group) during the same time period (for example, the first time period TP1). That is, the number of times of inversion of the voltage polarities of the data signals D1-Dm is less than the number of times of scanning of the gate driving circuit 124, thereby reducing driving power consumption and achieving power saving. Compared with the previous embodiment, a scan line group of this embodiment includes three scan lines, such that the data driving circuit 126 inverts voltage polarities of data signals after the gate driving circuit 124 finishes the scanning of three scan lines in this embodiment. Accordingly, driving power consumption may be reduced further in the display panel driving circuit 120 of this embodiment.

Besides, in some embodiment, grouping manner of scan line groups may be adjusted according to different design consideration. A scan line group including an outermost gate line (for example, an uppermost or lowermost gate line) may serve as, for instance, a second scan line group instead of a first scan line group. Please refer to FIG. 5, a display panel driving method 50 is substantially similar to the display panel driving method 40; however, grouping manners of the gate lines GL1-GLn are different. In this embodiment, the gate lines GL1-GLn may be grouped into first gate lines (also referred to as a first scan line group) and second gate lines (also referred to as a second scan line group). The first gate lines include the gate lines GL2, GL4, GL6. The second gate lines include the gate lines GL1, GL3, GL5. That is, the uppermost gate line GL1 is not categorized as the first scan line group. In this embodiment, the first gate lines GL2, GL4, GL6 are nonadjacent to each other but located in even rows; the second gate lines GL1, GL3, GL5 are nonadjacent to each other but located in odd rows.

Figure 5:
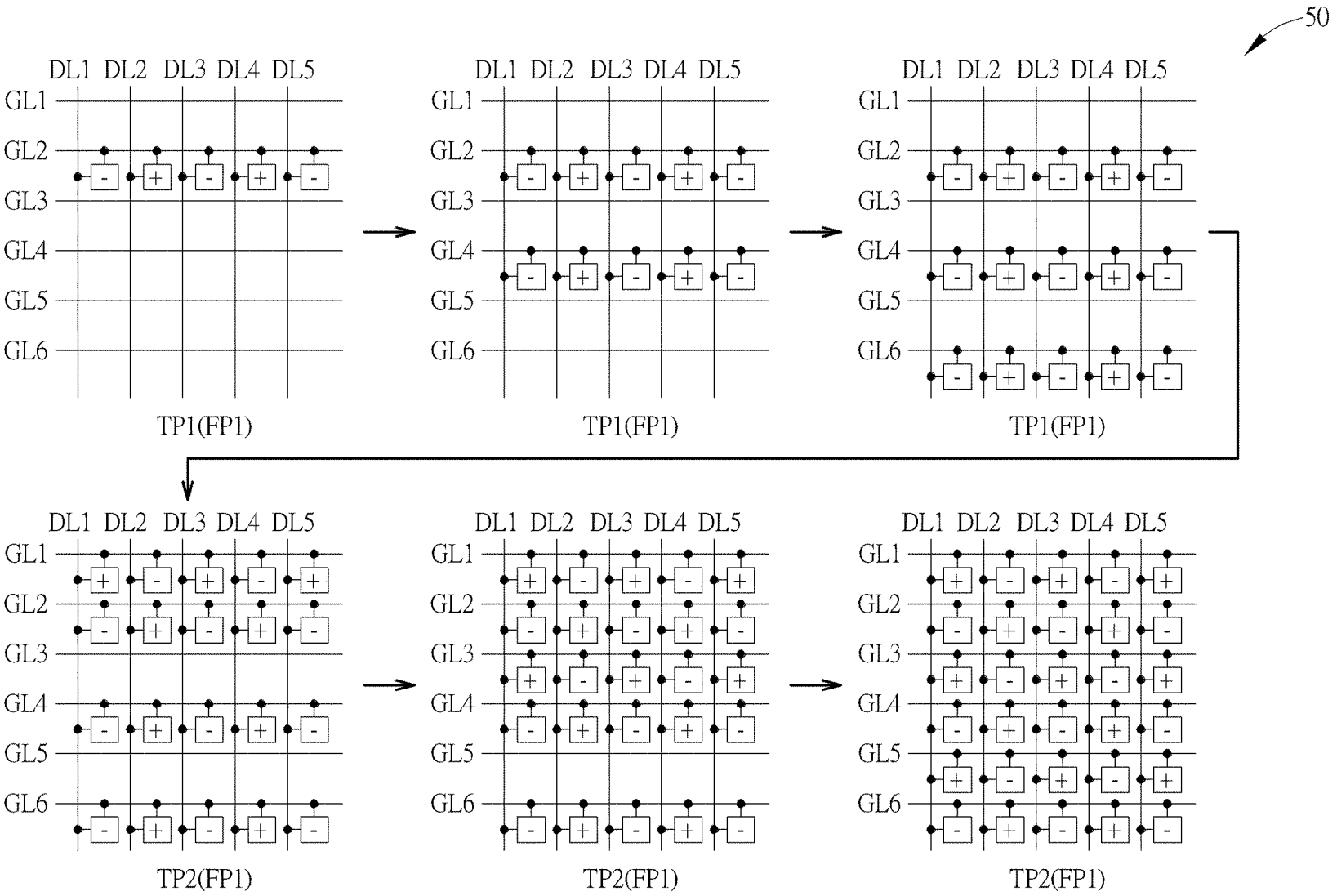

As shown in FIG. 5, during the first time period TP1 of the frame period FP1, the gate driving circuit 124 scans the first gate lines GL2, GL4, GL6 according to a first predetermined order, meaning that the gate driving circuit 124 transmits the gate driving signals G2, G4, G6 (also referred to as first gate driving signals) to the first gate lines GL2, GL4, GL6. The gate driving circuit 124 scans the first gate line GL2 first, then scans the first gate line GL4, and then scans the first gate line GL6. That is to say, the first predetermined order is sequenced in an ascending order of row numbers, and relates to a sequence of row numbers. However, the gate driving circuit 124 does not start scanning from the uppermost gate lines GL1.

In this embodiment, the data driving circuit 126 of the display panel driving circuit 120 employs dot inversion driving method. During the first time period TP1, voltage polarities of data signals located in two adjacent data lines DL1-DLm (for example, the data signal D1 of the data line DL1 and the data signal D2 of the data line DL2) are opposite, thereby ensuring display quality. However, during the first time period TP1, voltage polarity of any of the data signals D1-Dm located in the data lines DL1-DLm remains unchanged, and the data driving circuit 126 does not invert the voltage polarities of the data signals D1-Dm as the gate driving circuit 124 starts to scan another (different) gate line. As a result, the present invention may reduce driving power consumption and achieve power saving. Specifically, in this embodiment, voltage polarities of data signals of data lines located in odd columns (for example, the data signals D1, D3, D5 of the data lines DL1, DL3, DL5) are negative during all the first time period TP1. On the other hand, voltage polarities of data signals of data lines located in even columns (for example, the data signals D2, D4, D6 of the data lines DL2, DL4, DL6) are positive during all the first time period TP1.

During the second time period TP2 of the frame period FP1, the gate driving circuit 124 scans the second gate lines GL1, GL3, GL5 according to a second predetermined order, meaning that the gate driving circuit 124 transmits gate driving signals G1, G3, G5 (also referred to as second gate driving signals) to the second gate lines GL1, GL3, GL5. Specifically, in this embodiment, the gate driving circuit 124 scans the second gate line GL1 first, then scans the second gate line GL3, and then scans the second gate line GL5. That is to say, the second predetermined order is sequenced in an ascending order of row numbers, and relates to a sequence of row numbers.

During the second time period TP2, voltage polarities of data signals located in two adjacent data lines DL1-DLm (for example, the data signal D1 of the data line DL1 and the data signal D2 of the data line DL2) are opposite. Voltage polarities of data signals located in the data lines DL1-DLm during the first time period TP1 are opposite to those during the second time period TP2, thereby ensuring display quality. However, during the second time period TP2, voltage polarity of any of the data signals D1-Dm located in the data lines DL1-DLm remains unchanged. As a result, the present invention may reduce driving power consumption and achieve power saving. Specifically, in this embodiment, voltage polarities of data signals of data lines located in odd columns (for example, the data signals D1, D3, D5 of the data lines DL1, DL3, DL5) are positive during all the second time period TP2, and are opposite to the voltage polarities of data signals of data lines located in odd columns during the first time period TP1. On the other hand, voltage polarities of data signals of data lines located in even columns (for example, the data signals D2, D4, D6 of the data lines DL2, DL4, DL6) are negative during all the second time period TP2, and are opposite to the voltage polarities of data signals of data lines located in even columns during the first time period TP1.

Operations during other time periods TP3-TPi of the frame period FP1 are similar, and thus are not narrated hereinafter. Besides, operations during the time period TP1-TPi of the frame period FP2 are also similar, and thus are not narrated hereinafter. Noticeably, voltage polarities of data signals D1-Dm located in the data lines DL1-DLm during the time periods TP1-TPi of the frame period FP1 are opposite to those during the time periods TP1-TPi of the frame period FP2.

As may be seen from the above, the display panel driving method 50 of the display panel driving circuit 120 adopts dot inversion, thereby ensuring display quality. Besides, voltage polarity of a data signal (for example, the data signal D1) is inverted once every time a time period is passed (for example, from the first time period TP1 to the second time period TP2), and the gate driving circuit 124 scans a plurality of gate lines in one scan line group (for example, the first gate lines GL2, GL4, GL6 of the first scan line group) during the same time period (for example, the first time period TP1). That is, the number of times of inversion of the voltage polarities of the data signals D1-Dm is less than the number of times of scanning of the gate driving circuit 124, thereby reducing driving power consumption and achieving power saving.

Besides, in some embodiments, the numbers of gate lines in different scan line groups may vary. Specifically, please refer to FIG. 6, which is a schematic diagram of voltage polarities of data signals of the subpixels PIX of the display panel 100 based on a display panel driving method 60 according to an embodiment of the present invention. The display panel driving method 60 is substantially similar to the display panel driving method 30. Different from the display panel driving method 30, the numbers of gate lines in different scan line groups vary according to the display panel driving method 60. For example, the gate lines GL1-GLn may at least be grouped into the first gate lines GL1, GL3, GL5 (also referred to as a first scan line group), the second gate lines GL2, GL4 (also referred to as a second scan line group). That is, the number of the first gate lines GL1, GL3, GL5 is different from the number of the second gate lines GL2, GL4. The number of the first gate lines is 3. The first gate lines GL1, GL3, GL5 are nonadjacent to each other but located in odd rows. The number of the second gate lines is 2. The second gate lines GL2, GL4 are nonadjacent to each other but located in even rows.

Figure 6:
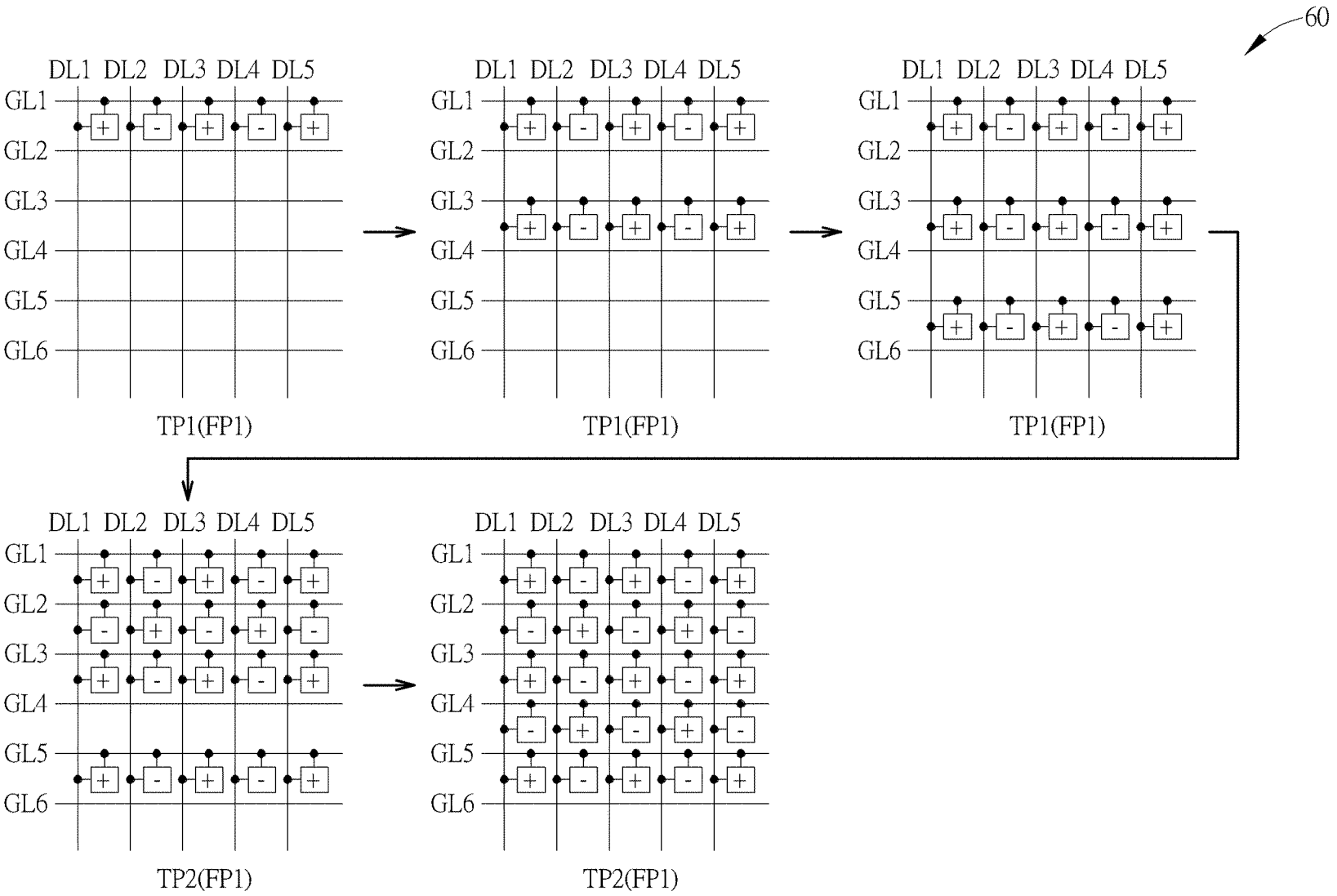

As shown in FIG. 6, during the first time period TP1 of the frame period FP1, the gate driving circuit 124 scans the first gate lines GL1, GL3, GL5 according to a first predetermined order, meaning that the gate driving circuit 124 transmits gate driving signals G1, G3, G5 (also referred to as first gate driving signals) to the first gate lines GL1, GL3, GL5. The first predetermined order is sequenced in an ascending order of row numbers.

During the second time period TP2 of the frame period FP1, the gate driving circuit 124 scans the second gate lines GL2, GL4 according to a second predetermined order, meaning that the gate driving circuit 124 transmits gate driving signals G2, G4 (also referred to as second gate driving signals) to the second gate lines GL2, GL4. The second predetermined order is sequenced in an ascending order of row numbers.

Operations during other time periods TP3-TPi of the frame period FP1 are similar, and thus are not narrated hereinafter. Besides, operations during the time period TP1-TPi of the frame period FP2 are also similar, and thus are not narrated hereinafter. Noticeably, voltage polarities of data signals D1-Dm located in the data lines DL1-DLm during the time periods TP1-TPi of the frame period FP1 are opposite to those during the time periods TP1-TPi of the frame period FP2.

Besides, in some embodiments, predetermined orders for the gate driving circuit 124 to scan gate lines of different scan line groups may be different. Specifically, please refer to FIG. 7, which is a schematic diagram of voltage polarities of data signals of the subpixels PIX of the display panel 100 based on display panel driving method 70 according to an embodiment of the present invention. The display panel driving method 70 is substantially similar to the display panel driving method 40. Different from the display panel driving method 40, the gate driving circuit 124 scans gate lines of different scan line groups in different predetermined orders according to the display panel driving method 70.

Figure 7:
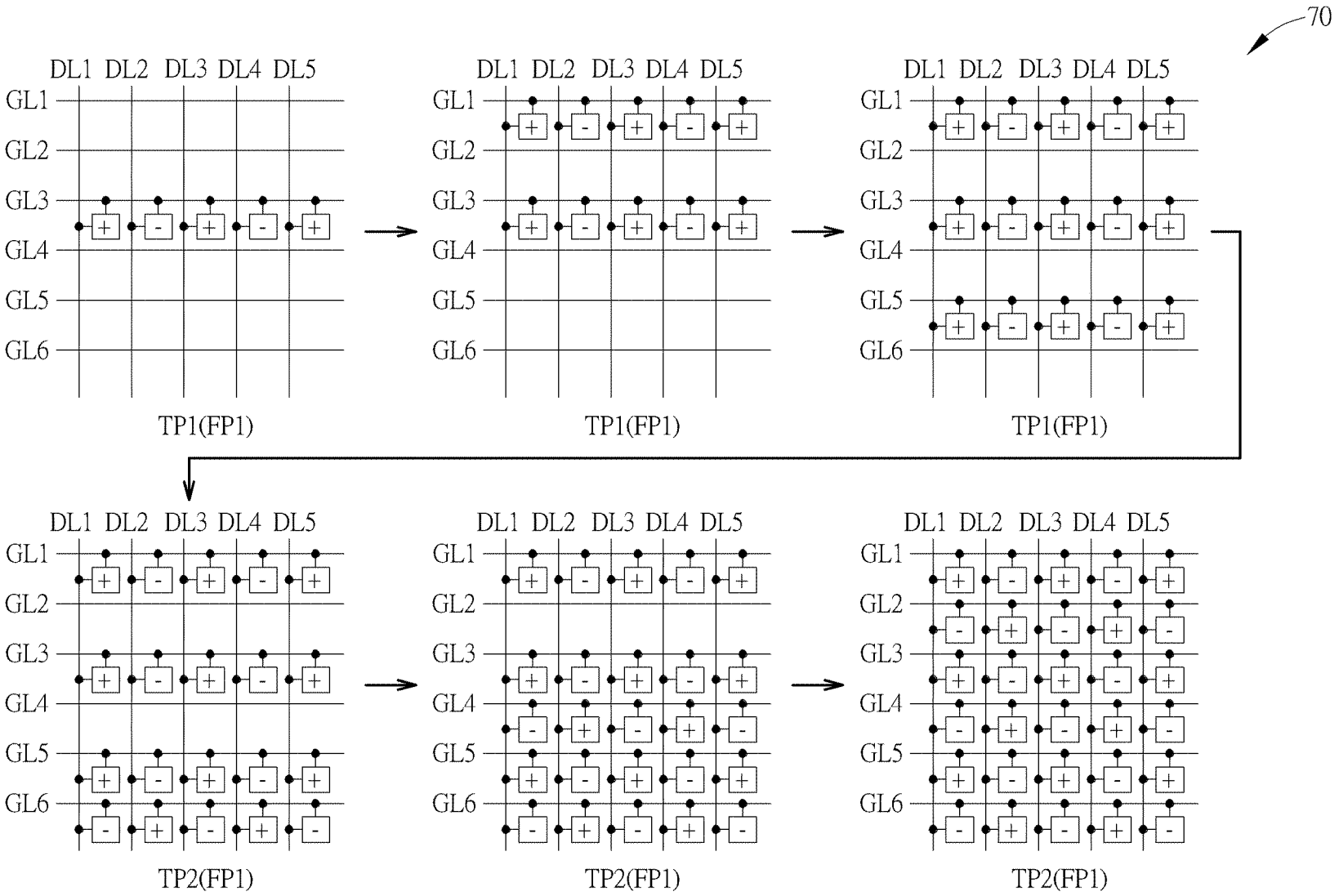

As shown in FIG. 7, during the first time period TP1 of the frame period FP1, the gate driving circuit 124 scans the first gate lines GL3, GL1, GL5 according to a first predetermined order, meaning that the gate driving circuit 124 transmits gate driving signals G3, G1, G5 (also referred to as first gate driving signals) to the first gate lines GL3, GL1, GL5. Specifically, in this embodiment, the gate driving circuit 124 scans the first gate line GL3 first, then scans the first gate line GL1, and then scans the first gate line GL5. That is, the first predetermined order does not directly relate to a sequence of row numbers.

During the second time period TP2 of the frame period FP1, the gate driving circuit 124 scans the second gate lines GL6, GL4, GL2 according to a second predetermined order, meaning that the gate driving circuit 124 transmits gate driving signals G6, G4, G2 (also referred to as second gate driving signals) to the second gate lines GL6, GL4, GL2. Specifically, in this embodiment, the gate driving circuit 124 scans the second gate line GL6 first, then scans the second gate line GL4, and then scans the second gate line GL2. That is, the second predetermined order is sequenced in a descending order of row numbers, and relates to a sequence of row numbers.

Operations during other time periods TP3-TPi of the frame period FP1 are similar, and thus are not narrated hereinafter. Besides, operations during the time period TP1-TPi of the frame period FP2 are also similar, and thus are not narrated hereinafter. Noticeably, voltage polarities of data signals D1-Dm located in the data lines DL1-DLm during the time periods TP1-TPi of the frame period FP1 are opposite to those during the time periods TP1-TPi of the frame period FP2.

Figure 8A:
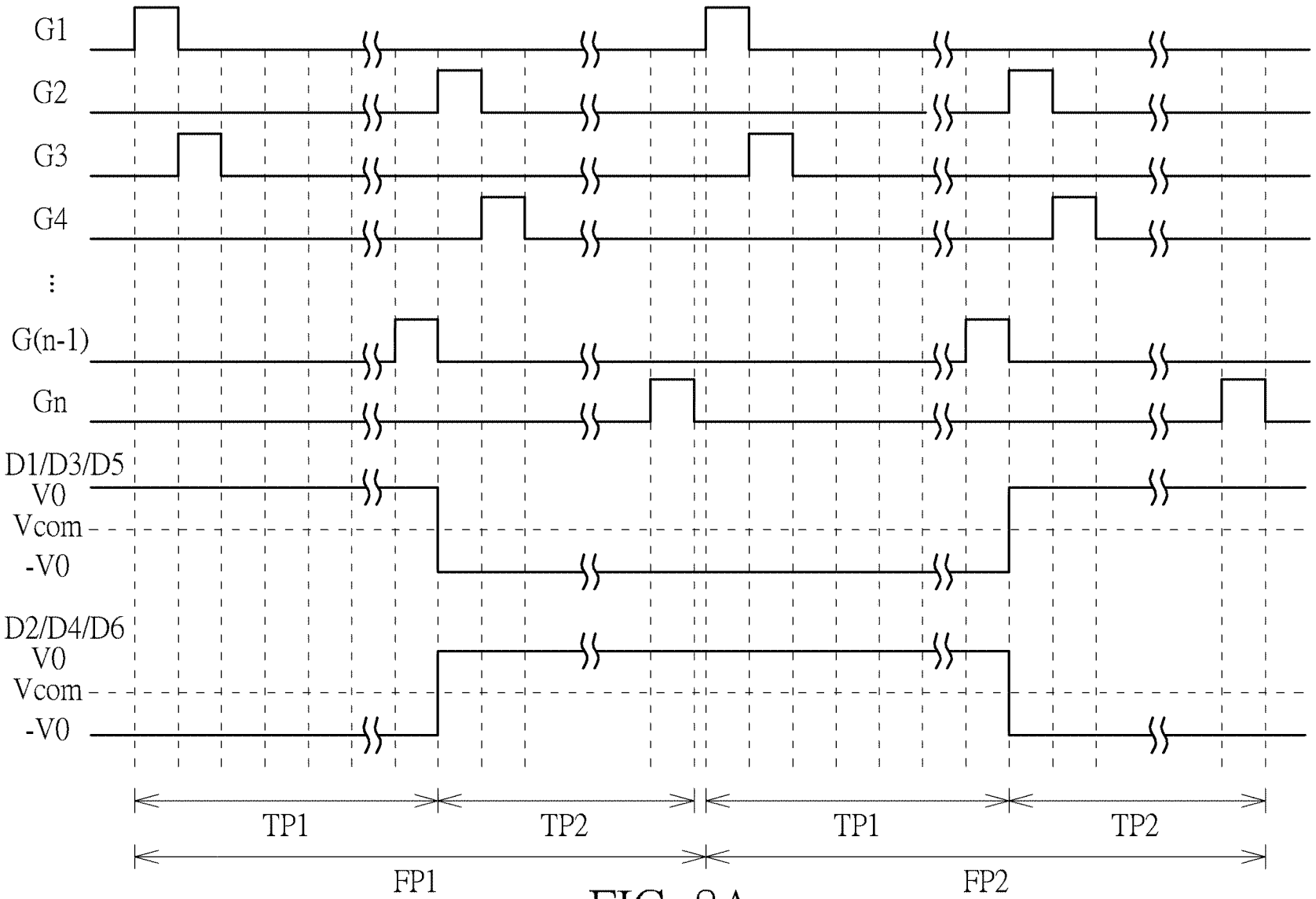
FIG. 8A is a timing diagram of gate driving signals and data signals based on a display panel driving method according to an embodiment of the present invention.
Figure 8B:
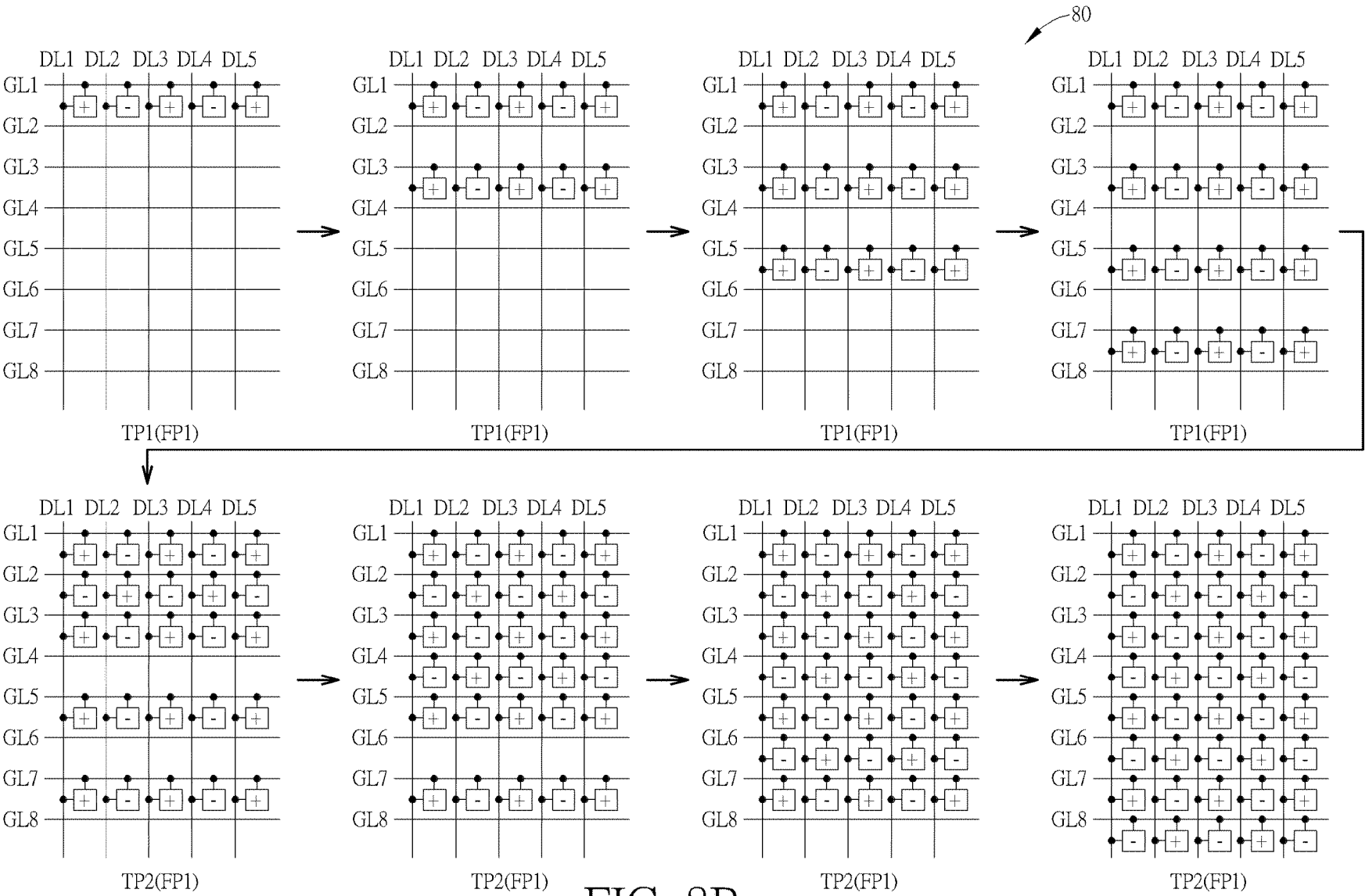
FIG. 8B is a schematic diagram of voltage polarities of data signals of the subpixels of the display panel based on a display panel driving method according to an embodiment of the present invention.

Besides, in some embodiments, the gate lines GL1-GLn may be directly divided into two scan line groups. Please refer to FIG. 8A and FIG. 8B. FIG. 8A is a timing diagram of gate driving signals and data signals based on the display panel driving method 80 according to an embodiment of the present invention. FIG. 8B is a schematic diagram of voltage polarities of data signals of the subpixels PIX of the display panel 100 based on the display panel driving method 80 according to an embodiment of the present invention. The display panel driving method 80 is substantially similar to the display panel driving method 30. Different from the display panel driving method 30, the frame periods FP1, FP2 may include the first time period TP1 and the second time period TP2, respectively, in the display panel driving method 80. Besides, the gate lines GL1-GLn may be divided into first gate lines GL1, GL3, GL5, . . . , GL(n−1) and second gate lines GL2, GL4, GL6, . . . , GLn. In this embodiment, the first gate lines GL1-GL(n−1) are nonadjacent to each other but located in odd rows; the second gate lines GL2-GLn are nonadjacent to each other but located in even rows. When the number of the gate lines GL1-GLn is 2N with N belonging to a positive integral, the number of the first gate lines GL1-GL(n−1) is N, and the number of the second gate lines GL2-GLn is N. In other words, when the number of gate driving signals G1-Gn is 2N, the number of first gate driving signals G1-G(n−1) is N, and the number of second gate driving signals G2-Gn is N. When the number of the gate lines GL1-GLn is 2N+1 with N belonging to a positive integral, the number of the first gate lines GL1-GL(n−1) is N+1, and the number of the second gate lines GL2-GLn is N. In other words, when the number of the gate driving signals G1-Gn is 2N+1, the number of the first gate driving signals G1-G(n−1) is N+1, and the number of the second gate driving signals G2-Gn is N.

As shown in FIG. 8A and FIG. 8B, during the first time period TP1 of the frame period FP1, the gate driving circuit 124 scans the first gate lines GL1-GL(n−1) according to a first predetermined order, meaning that the gate driving circuit 124 transmits gate driving signals G1-G(n−1) (also referred to as first gate driving signals) to the first gate lines GL1-GL(n−1). The first predetermined order may be sequenced in an ascending order of row numbers.

During the first time period TP1, voltage polarities of data signals D1-Dm located in two adjacent data lines DL1-DLm (for example, the data signal D1 of the data line DL1 and the data signal D2 of the data line DL2) are opposite, thereby ensuring display quality; However, during the first time period TP1, voltage polarity of any of the data signals D1-Dm located in the data lines DL1-DLm remains unchanged, and the data driving circuit 126 does not invert the voltage polarities of the data signals D1-Dm as the gate driving circuit 124 starts to scan another (different) gate line. As a result, the present invention may reduce driving power consumption and achieve power saving. Specifically, in this embodiment, voltage polarities of data signals of data lines located in odd columns (for example, the data signals D1, D3, D5 of the data lines DL1, DL3, DL5) are positive during all the first time period TP1. On the other hand, voltage polarities of data signals of data lines located in even columns (for example, the data signals D2, D4, D6 of the data lines DL2, DL4, DL6) are negative during all the first time period TP1.

During the second time period TP2 of the frame period FP1, the gate driving circuit 124 scans the second gate lines GL2-GLn according to a second predetermined order, meaning that the gate driving circuit 124 transmits gate driving signals G2-Gn (also referred to as second gate driving signals) to the second gate lines GL2-GLn. The second predetermined order may be sequenced in an ascending order of row numbers.

During the second time period TP2, voltage polarities of data signals located in two adjacent data lines DL1-DLm (for example, the data signal D1 of the data line DL1 and the data signal D2 of the data line DL2) are opposite. Voltage polarities of data signals located in the data lines DL1-DLm during the first time period TP1 are opposite to those during the second time period TP2, thereby ensuring display quality. However, during the second time period TP2, voltage polarity of any of the data signals D1-Dm located in the data lines DL1-DLm remains unchanged. As a result, the present invention may reduce driving power consumption and achieve power saving. Specifically, in this embodiment, voltage polarities of data signals of data lines located in odd columns (for example, the data signals D1, D3, D5 of the data lines DL1, DL3, DL5) are negative during all the second time period TP2, and are opposite to voltage polarities of data signals of data lines located in odd columns during the first time period TP1. On the other hand, voltage polarities of data signals of data lines located in even columns (for example, the data signals D2, D4, D6 of the data lines DL2, DL4, DL6) are positive during all the second time period TP2, and are opposite to the voltage polarities of data signals of data lines located in even columns during the first time period TP1.

Operations during the first time period TP1 and the second time period TP2 of the frame period FP2 are also similar, and thus are not narrated hereinafter. Noticeably, voltage polarities of data signals D1-Dm located in the data lines DL1-DLm during the first time period TP1 or the second time period TP2 of the frame period FP1 are opposite to those during the first time period TP1 or the second time period TP2 of the frame period FP2.

As may be seen from the above, the display panel driving method 80 of the display panel driving circuit 120 adopts dot inversion, thereby ensuring display quality. Besides, voltage polarity of a data signal (for example, the data signal D1) is inverted merely once whenever a time period is passed (for example, the change from the first time period TP1 to the second time period TP2), and the gate driving circuit 124 scans a plurality of gate lines in one same scan line group (for example, the first gate lines GL1-GL(n−1)) during the same time period (for example, the first time period TP1). That is, the number of times of inversion of the voltage polarities of the data signals D1-Dm is less than the number of times of scanning of the gate driving circuit 124, thereby reducing driving power consumption and achieving power saving.

Besides, in some embodiments, 2-dot inversion driving method may be utilized to drive the subpixels PIX of the display panel 100. In such situation, the display panel driving method of the present invention may be applied to reduce driving power consumption and achieve power saving. Please refer to FIG. 9, which is a schematic diagram of voltage polarities of data signals of subpixels of a display panel based on the display panel driving method 90 according to an embodiment of the present invention. The display panel driving method 90 is substantially similar to the display panel driving method 30. In this embodiment, the gate lines GL1-GLn may be grouped into first gate lines (also referred to as a first scan line group) and second gate lines (also referred to as a second scan line group). The first gate lines include the gate lines GL1, GL2, GL5, and GL6. The second gate lines include the gate lines GL3, GL4, GL7, and GL8. That is, the number of the first gate lines and the number of the second gate lines are 4, respectively. The first gate lines GL1, GL2, GL5, and GL6 are not all located in odd rows or all located in even rows. The first gate lines GL1, GL2 are adjacent to each other; the first gate lines GL5, GL6 are adjacent to each other. Similarly, the second gate lines GL3, GL4, GL7, and GL8 are not all located in odd rows or all located in even rows. The second gate lines GL3, GL4 are adjacent to each other; the second gate lines GL7, GL8 are adjacent to each other.

Figure 9:
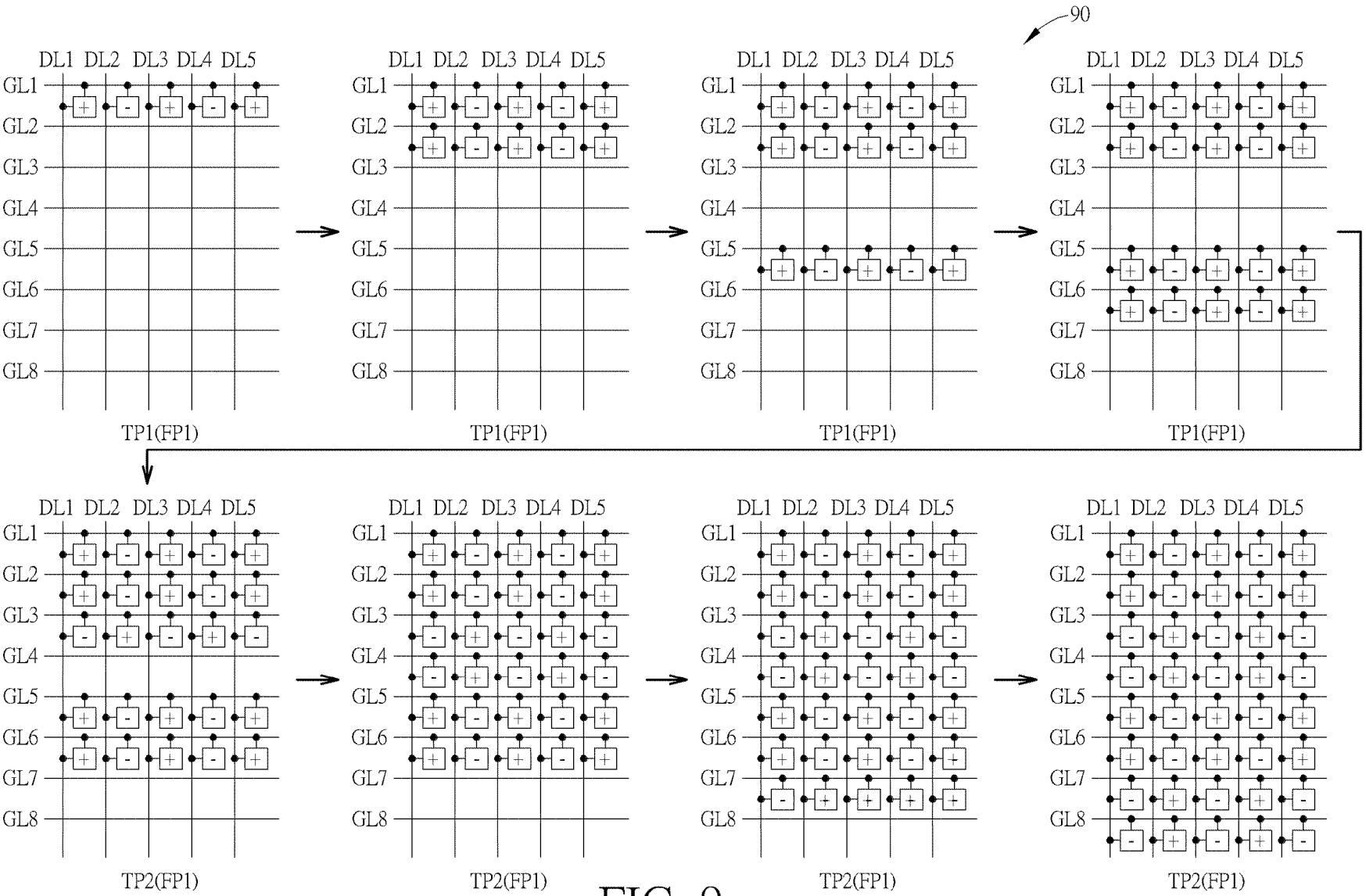
FIG. 9 is a schematic diagram of voltage polarities of data signals of subpixels of a display panel based on a display panel driving method according to an embodiment of the present invention.

As shown in FIG. 9, during the first time period TP1 of the frame period FP1, the gate driving circuit 124 scans the first gate lines GL1, GL2, GL5, GL6 according to a first predetermined order, meaning that the gate driving circuit 124 transmits the gate driving signals G1, G2, G5, G6 (also referred to as first gate driving signals) to the first gate lines GL1, GL2, GL5, GL6. The first predetermined order may be sequenced in an ascending order of row numbers, meaning that the first predetermined order relates to a sequence of row numbers. Alternatively, the first predetermined order may not be directly related to the sequence of row numbers as illustrated in previous embodiments.

During the first time period TP1 of the frame period FP1, voltage polarities of data signals located in two adjacent data lines DL1-DLm (for example, the data signal D1 of the data line DL1 and the data signal D2 of the data line DL2) are opposite. However, during the first time period TP1, voltage polarity of any of the data signals D1-Dm located in the data lines DL1-DLm remains unchanged, and the data driving circuit 126 does not invert the voltage polarities of the data signals D1-Dm as the gate driving circuit 124 starts to scan another (different) gate line. As a result, the present invention may reduce driving power consumption and achieve power saving. In this embodiment, voltage polarities of data signals of data lines located in odd columns (for example, the data signals D1, D3, D5 of the data lines DL1, DL3, DL5) are positive during all the first time period TP1. On the other hand, voltage polarities of data signals of data lines located in even columns (for example, the data signals D2, D4 of the data lines DL2, DL4) are negative during all the first time period TP1.

During the second time period TP2 of the frame period FP1, the gate driving circuit 124 scans the second gate lines GL3, GL4, GL7, GL8 according to a second predetermined order, meaning that the gate driving circuit 124 transmits gate driving signals G3, G4, G7, G8 (also referred to as second gate driving signals) to the second gate lines GL3, GL4, GL7, GL8. The second predetermined order may be sequenced in an ascending order of row numbers, meaning that the second predetermined order relates to a sequence of row numbers. Alternatively, the second predetermined order may not be directly related to the sequence of row numbers as illustrated in previous embodiments.

During the second time period TP2, voltage polarities of data signals D1-Dm located in two adjacent data lines DL1-DLm (for example, the data signal D1 of the data line DL1 and the data signal D2 of the data line DL2) are opposite. Voltage polarities of data signals D1-Dm located in the data lines DL1-DLm during the first time period TP1 are opposite to those during the second time period TP2. However, during the second time period TP2, voltage polarity of any of the data signals D1-Dm located in the data lines DL1-DLm remains unchanged. As a result, the present invention may reduce driving power consumption and achieve power saving. In this embodiment, voltage polarities of data signals of data lines located in odd columns (for example, the data signals D1, D3, D5 of the data lines DL1, DL3, DL5) are negative during all the second time period TP2, and are opposite to the voltage polarities of data signals of data lines located in odd columns during the first time period TP1. On the other hand, voltage polarities of data signals of data lines located in even columns (for example, the data signals D2, D4 of the data lines DL2, DL4) are positive during all the second time period TP2, and are opposite to the voltage polarities of data signals of data lines located in even columns during the first time period TP1.

Operations during other time periods TP3-TPi of the frame period FP1 are similar, and thus are not narrated hereinafter. Besides, operations during the time period TP1-TPi of the frame period FP2 are also similar, and thus are not narrated hereinafter. Noticeably, voltage polarities of data signals D1-Dm located in the data lines DL1-DLm during the time periods TP1-TPi of the frame period FP1 are opposite to those during the time periods TP1-TPi of the frame period FP2. As set forth above, the display panel driving method of the present invention may be applied in other multiple dot inversion driving methods such as 3-dot inversion driving method, 4-dot inversion driving method and so on to driving the subpixels PIX of the display panel 100.

In some embodiments, a row inversion driving method may be applied to drive the subpixels PIX of the display panel 100. In such situation, the display panel driving method of the present invention may be applied to reduce driving power consumption and achieve power saving. Please refer to FIG. 10, which is a schematic diagram of voltage polarities of data signals of subpixels of a display panel based on the display panel driving method 95 according to an embodiment of the present invention. The display panel driving method 95 is substantially similar to the display panel driving method 30. In this embodiment, the gate lines GL1-GLn may be grouped into first gate lines (also referred to as a first scan line group), second gate lines (also referred to as a second scan line group), third gate lines (also referred to as a third scan line group), and fourth gate lines (also referred to as a fourth scan line group). The first gate lines include the gate lines GL1, GL3. The second gate lines include the gate lines GL2, GL4. The third gate lines include the gate lines GL5, GL7. The fourth gate lines include the gate lines GL6, GL8. That is, the number of the first gate lines, the number of the second gate lines, the number of the third gate lines, and the number of the fourth gate lines are 2, respectively. The first gate lines GL1, GL3 and the third gate lines GL5, GL7 are located in odd rows. The first gate lines GL1, GL3 and the third gate lines GL5, GL7 are nonadjacent to each other. The second gate lines GL2, GL4 and the fourth gate lines GL6, GL8 are located in even rows. The second gate lines GL2, GL4 and the fourth gate lines GL6, GL8 are nonadjacent to each other.

Figure 10:
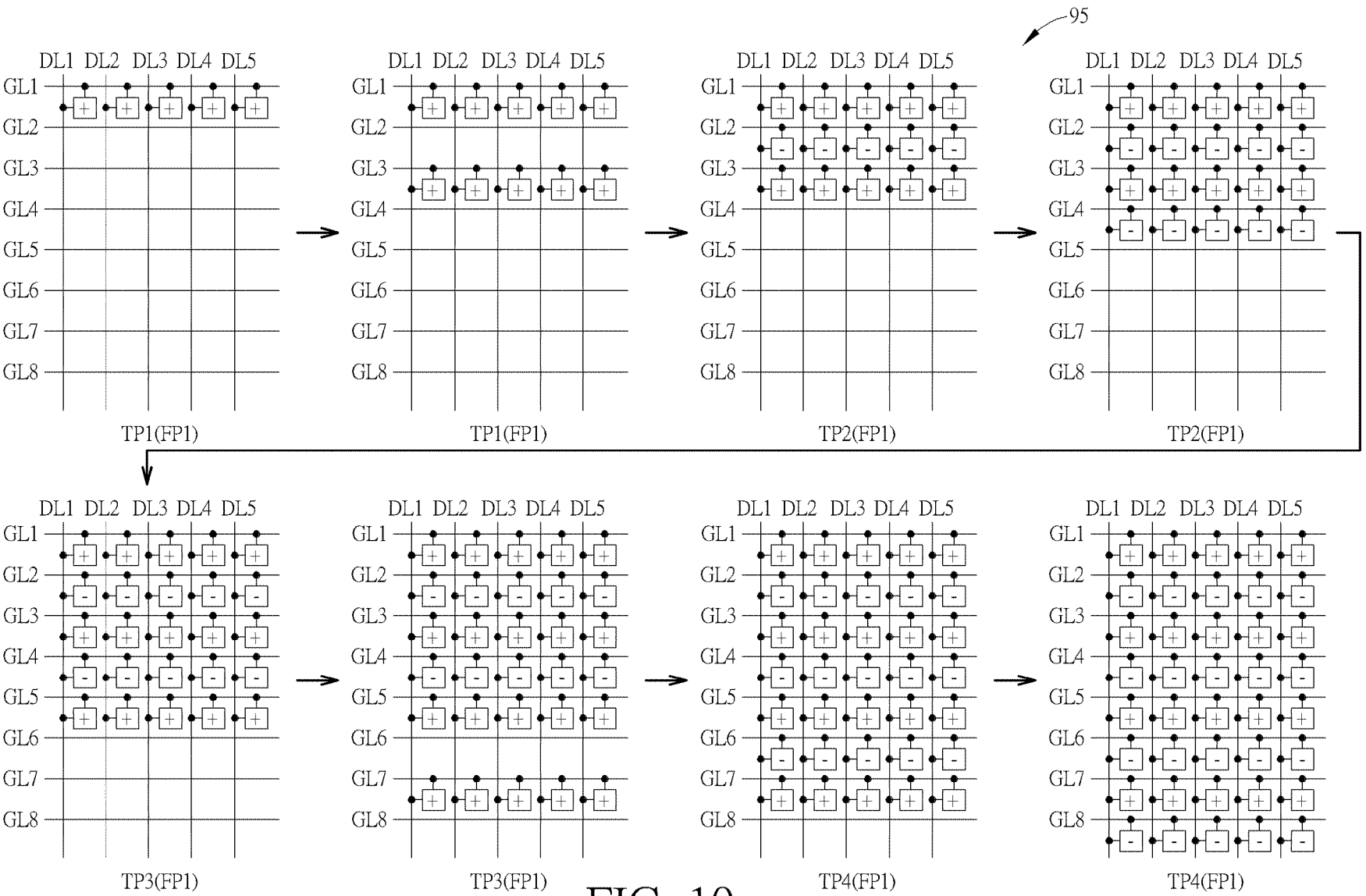
FIG. 10 is a schematic diagram of voltage polarities of data signals of subpixels of a display panel based on a display panel driving method according to an embodiment of the present invention.

As shown in FIG. 10, during the first time period TP1 of the frame period FP1, the gate driving circuit 124 scans the first gate lines GL1, GL3 according to a first predetermined order, meaning that the gate driving circuit 124 transmits the gate driving signals G1, G3 (also referred to as first gate driving signals) to the first gate lines GL1, GL3. During the first time period TP1, voltage polarities of the data signals D1-Dm located in the data lines DL1-DLm (for example, the data signal D1 of the data line DL1, the data signal D2 of the data line DL2 and the data signal D3 of the data line DL3) are the same. However, during the first time period TP1, voltage polarity of any of the data signals D1-Dm located in the data lines DL1-DLm remains unchanged, and the data driving circuit 126 does not invert the voltage polarities of the data signals D1-Dm as the gate driving circuit 124 starts to scan another (different) gate line. As a result, the present invention may reduce driving power consumption and achieve power saving. In this embodiment, voltage polarities of data signals D1-Dm of data lines DL1-DLm are positive during all the first time period TP1.

During the second time period TP2 of the frame period FP1, the gate driving circuit 124 scans the second gate lines GL2, GL4 according to a second predetermined order, meaning that the gate driving circuit 124 transmits gate driving signals G2, G4 (also referred to as second gate driving signals) to the second gate lines GL2, GL4. During the second time period TP2, voltage polarities of the data signals D1-Dm located in the data lines DL1-DLm (for example, the data signal D1 of the data line DL1, the data signal D2 of the data line DL2 and the data signal D3 of the data line DL3) are the same. Voltage polarities of data signals D1-Dm located in the data lines DL1-DLm during the first time period TP1 are opposite to those during the second time period TP2. However, during the second time period TP2, voltage polarity of any of the data signals D1-Dm located in the data lines DL1-DLm remains unchanged. As a result, the present invention may reduce driving power consumption and achieve power saving. In this embodiment, voltage polarities of data signals D1-Dm of data lines DL1-DLm are negative during all the second time period TP2, and are opposite to the voltage polarities of data signals D1-Dm of data lines DL1-DLm during the first time period TP1.

During the third time period TP3 of the frame period FP1, the gate driving circuit 124 scans the third gate lines GL5, GL7 according to a third predetermined order, meaning that the gate driving circuit 124 transmits gate driving signals G5, G7 (also referred to as third gate driving signals) to the third gate lines GL5, GL7. During the third time period TP3, voltage polarities of data signals D1-Dm located in the data lines DL1-DLm are the same. Voltage polarities of data signals D1-Dm located in the data lines DL1-DLm during the second time period TP2 are opposite to those during the third time period TP3. However, during the third time period TP3, voltage polarity of any of the data signals D1-Dm located in the data lines DL1-DLm remains unchanged. In this embodiment, voltage polarities of data signals D1-Dm of data lines DL1-DLm are positive during all the third time period TP3, and are opposite to the voltage polarities of data signals D1-Dm of data lines DL1-DLm during the second time period TP2.

During the fourth time period TP4 of the frame period FP1, the gate driving circuit 124 scans the fourth gate lines GL6, GL8 according to a fourth predetermined order, meaning that the gate driving circuit 124 transmits gate driving signals G6, G8 (also referred to as fourth gate driving signals) to the fourth gate lines GL6, GL8. During the fourth time period TP4, voltage polarities of data signals D1-Dm of the data lines DL1-DLm are the same. Voltage polarities of data signals D1-Dm located in the data lines DL1-DLm during the third time period TP3 are opposite to those during the fourth time period TP4. However, during the fourth time period TP4, voltage polarity of any of the data signals D1-Dm located in the data lines DL1-DLm remains unchanged. In this embodiment, voltage polarities of data signals of data lines are negative during all the fourth time period TP4, and are opposite to the voltage polarities of data signals of data lines during the third time period TP3.

Operations during other time periods TP5-TPi of the frame period FP1 are similar, and thus are not narrated hereinafter. Besides, operations during the time period TP1-TPi of the frame period FP2 are also similar, and thus are not narrated hereinafter. Noticeably, voltage polarities of data signals D1-Dm located in the data lines DL1-DLm during the time periods TP1-TPi of the frame period FP1 are opposite to those during the time periods TP1-TPi of the frame period FP2.

To sum up, the display panel driving method of the present invention reduces the number of times of inversion of voltage polarities of data signals, thereby reducing driving power consumption and achieving power saving.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display panel driving method, comprising:

scanning a plurality of first gate lines of a plurality of gate lines according to a first predetermined order during a first time period of a frame period, wherein a voltage polarity of a data signal located in any of a plurality of data lines remains unchanged during the first time period; and scanning a plurality of second gate lines of the plurality of gate lines according to a second predetermined order during a second time period of the frame period, wherein the voltage polarity of the data signal located in any of the plurality of data lines remains unchanged during the second time period, wherein an outermost gate line of the plurality of gate lines is scanned after another of the plurality of gate lines during the frame period, wherein the first predetermined order or the second predetermined order is unrelated to a sequence of row numbers.

2. The display panel driving method of claim 1, wherein a number of the plurality of gate lines is 2N or 2N+1, a number of the plurality of first gate lines is in a range of 2 to N+1, a number of the plurality of second gate lines is in a range of 2 to N+1, and N is a positive integral.

3. The display panel driving method of claim 1, wherein the plurality of first gate lines are located in odd rows, and the plurality of second gate lines are located in even rows.

4. The display panel driving method of claim 1, wherein one of the plurality of first gate lines is located in an $M^{th}$ row, another of the plurality of first gate lines is located in an $M+x^{th}$ row, one of the plurality of second gate lines is located in an $M+y^{th}$ row, another of the plurality of second gate lines is located in $M+y+z^{th}$ row, M is an positive integral, and x, y, z are integrals.

5. The display panel driving method of claim 1, wherein voltage polarities of data signals located in two adjacent ones of the plurality of data lines are opposite during the first time period or the second time period.

6. The display panel driving method of claim 1, wherein the voltage polarity of the data signal located in any of the plurality of data lines during the first time period is opposite to the voltage polarity of the data signal during the second time period.

7. The display panel driving method of claim 1, further comprising:

scanning a plurality of third gate lines of the plurality of gate lines according to a third predetermined order during a third time period of the frame period, wherein the voltage polarity of the data signal located in any of the plurality of data lines remains unchanged during the third time period; and scanning a plurality of fourth gate lines of the plurality of gate lines according to a fourth predetermined order during a fourth time period of the frame period, wherein the voltage polarity of the data signal located in any of the plurality of data lines remains unchanged during the fourth time period.

8. The display panel driving method of claim 1, wherein the plurality of first gate lines are nonadjacent, wherein the plurality of second gate lines are nonadjacent.

9. A display panel driving circuit, comprising:

a gate driving circuit, generating a plurality of gate driving signals and transmitting the plurality of gate driving signals to a plurality of gate lines of a display panel, the plurality of gate driving signals comprising a plurality of first gate driving signals and a plurality of second gate driving signals, wherein the gate driving circuit transmits the plurality of first gate driving signals according to a first predetermined order during a first time period of a frame period and transmits the plurality of second gate driving signals according to a second predetermined order during a second time period of the frame period, wherein an outermost gate line of the plurality of gate lines is scanned after another of the plurality of gate lines during the frame period, wherein the first predetermined order or the second predetermined order is unrelated to a sequence of row numbers; and a data driving circuit, generating a plurality of data signals and transmitting the plurality of data signals to the display panel, wherein a voltage polarity of any of the plurality of data signals remains unchanged during the first time period, and the voltage polarity of any of the plurality of data signals remains unchanged during the second time period.

10. The display panel driving circuit of claim 9, wherein a number of the plurality of gate driving signals is 2N or 2N+1, a number of the plurality of first gate driving signals is in a range of 2 to N+1, a number of the plurality of second gate driving signals is in a range of 2 to N+1, and N is a positive integral.

11. The display panel driving circuit of claim 9, wherein the gate driving circuit transmits the plurality of first gate driving signals to a plurality of first gate lines of the plurality of gate lines according to the first predetermined order to scan the plurality of first gate lines during the first time period, and transmits the plurality of second gate driving signals to a plurality of second gate lines of the plurality of gate lines according to the second predetermined order to scan the plurality of second gate lines during the second time period.

12. The display panel driving circuit of claim 11, wherein the plurality of first gate lines are located in odd rows, and the plurality of second gate lines are located in even rows.

13. The display panel driving circuit of claim 11, wherein one of the plurality of first gate lines is located in an $M^{th}$ row, another of the plurality of first gate lines is located in an $M+x^{th}$ row, one of the plurality of second gate lines is located in an $M+y^{th}$ row, another of the plurality of second gate lines is located in $M+y+z^{th}$ row, M is an positive integral, and x, y, z are integrals.

14. The display panel driving circuit of claim 9, wherein the data driving circuit transmits the plurality of data signals to the display panel and voltage polarities of two adjacent ones of the plurality of data signals are opposite during the first time period or the second time period.

15. The display panel driving circuit of claim 9, wherein the voltage polarity of one of the plurality of data signals during the first time period is opposite to the voltage polarity of the data signal during the second time period.

16. The display panel driving circuit of claim 9, wherein the plurality of gate driving signals further comprises a plurality of third gate driving signals and a plurality of fourth gate driving signals, wherein the gate driving circuit transmits the plurality of third gate driving signals according to a third predetermined order during a third time period of the frame period, the voltage polarity of any of the plurality of data signals remains unchanged during the third time period, the gate driving circuit transmits the plurality of fourth gate driving signals according to a fourth predetermined order during a fourth time period of the frame period, the voltage polarity of any of the plurality of data signals remains unchanged during the fourth time period.

17. The display panel driving circuit of claim 9, wherein the plurality of first gate driving signals are nonadjacent in the display panel, wherein the plurality of second gate driving signals are nonadjacent in the display panel.

* * * * *